US009770669B2

(12) United States Patent
Romer, Jr.

(10) Patent No.: US 9,770,669 B2
(45) Date of Patent: Sep. 26, 2017

(54) STARTING GATE ACTIVATION SYSTEM

(71) Applicant: Ronald Louis Romer, Jr., Jarrettsville, MD (US)

(72) Inventor: Ronald Louis Romer, Jr., Jarrettsville, MD (US)

( * ) Notice: Subject to any disclaimer, the term of this patent is extended or adjusted under 35 U.S.C. 154(b) by 136 days.

(21) Appl. No.: 14/604,761

(22) Filed: Jan. 26, 2015

(65) Prior Publication Data

US 2016/0214026 A1 Jul. 28, 2016

(51) Int. Cl.
*A63K 3/02* (2006.01)

(52) U.S. Cl.
CPC ..... *A63K 3/02* (2013.01)

(58) Field of Classification Search
CPC ..... A63K 3/02; G06F 21/44
See application file for complete search history.

(56) References Cited

U.S. PATENT DOCUMENTS 7,900,399 B2 * 3/2011 Williams ..... A63K 3/023 404/9
2007/0207868 A1 * 9/2007 Burry ..... A63K 3/02 472/85
2007/0248409 A1 * 10/2007 Barker ..... A63K 3/02 404/6
2008/0222960 A1 * 9/2008 Williams ..... A63K 3/023 49/324
2009/0045978 A1 * 2/2009 Weitzhandler ..... G06Q 30/06 340/933
2012/0188054 A1 * 7/2012 Bongard ..... G07C 9/00309 340/5.61
2013/0057695 A1 * 3/2013 Huisking ..... H04N 7/186 348/156
2014/0113592 A1 * 4/2014 Wu ..... G06F 21/44 455/411
2016/0029114 A1 * 1/2016 Chen ..... H04R 1/1041 381/74

* cited by examiner

*Primary Examiner* — William H McCulloch, Jr.
*Assistant Examiner* — Yingchuan Zhang
(74) *Attorney, Agent, or Firm* — Garrett O'Sullivan; Eric Lovell; Marc Shropshire

(57) ABSTRACT

An apparatus used in bicycle and other forms of racing, consisting of an activation mechanism operatively coupled to a starting gate and which additionally provides a means to operatively couple any of a variety of commonly available programmable multi-purpose electronic devices, which may be of a hand-held variety, including devices known as smart phones, such that the programmable devices may perform the gate controlling function in a desired manner or by parameters specified by race sanctioning organizations.

17 Claims, 1 Drawing Sheet

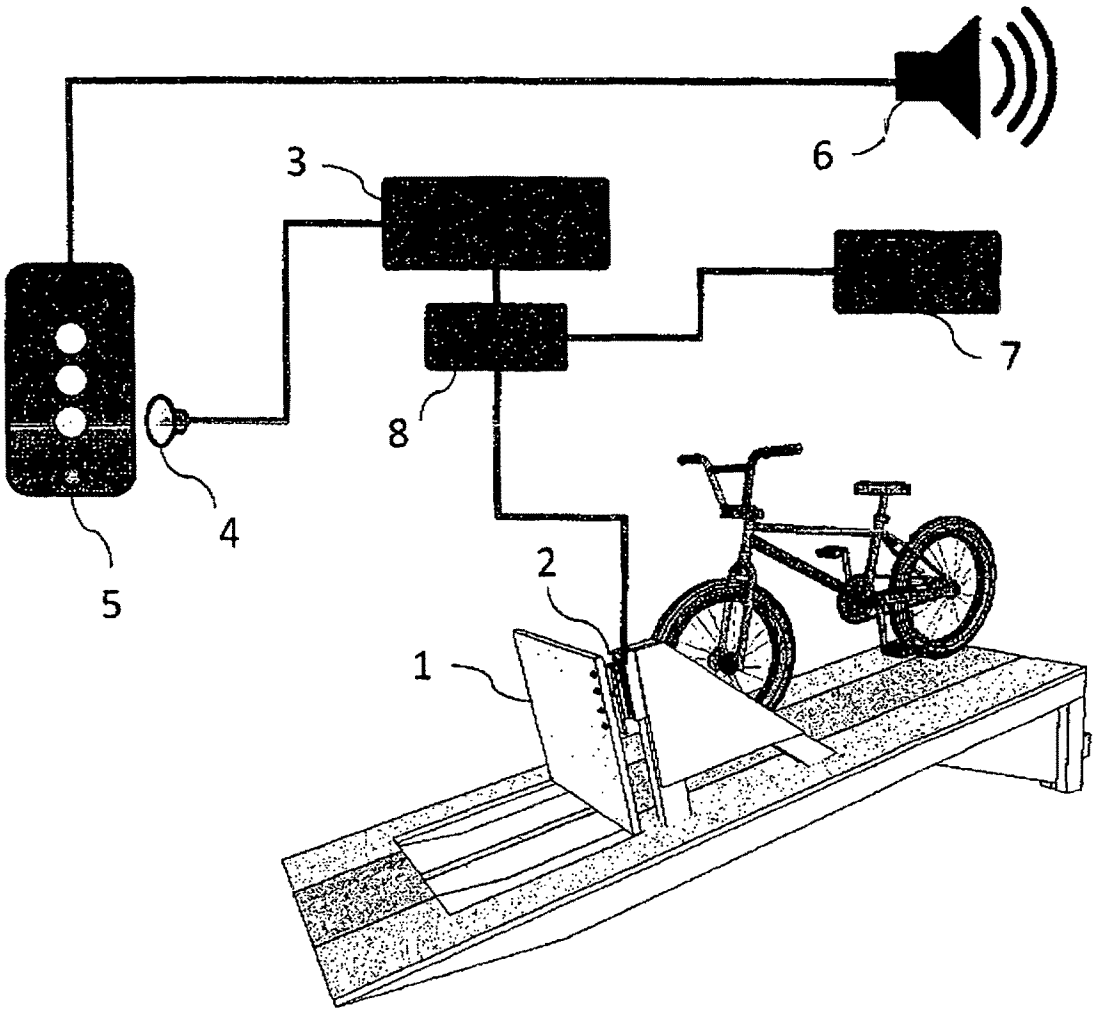
6
7
3
8
2
1
4
5

STARTING GATE ACTIVATION SYSTEM

BACKGROUND OF THE INVENTION

The present invention relates to a control mechanism and, more particularly, to a control mechanism for a starting gate.

Bicycle motocross (BMX) and many mountain bike races use starting gates. The starting technique can be among the most important skills a racer can master. Currently, racers must practice on the starting gates at the race track unless they invest in the same expensive equipment to use for their personal training. This expense is generally cost prohibitive.

Prior art is either mechanical and/or requires a second operator and/or requires the purchase of specialized dedicated control electronics. There are prior patents for gate control devices, such as US20070207868 A1, which includes devices operated by wire or wirelessly to release a starting gate after a specified time period or randomly. However, these devices require dedicated gate controllers, which can be cost prohibitive for most racers and/or the functions are limited.

As can be seen, there is a need for improved controlling mechanism for a starting gate.

BRIEF DESCRIPTION OF THE DRAWINGS

The FIGURE is a schematic view of an embodiment of the present invention.

DETAILED DESCRIPTION OF THE INVENTION

This application claims the benefit of U.S. Provisional Application No. 61/932,061, filed Jan. 27, 2014.

The following detailed description is of the best currently contemplated modes of carrying out exemplary embodiments of the invention. The description is not to be taken in a limiting sense, but is made merely for the purpose of illustrating the general principles of the Invention, since the scope of the invention is best defined by the appended claims.

Broadly, an embodiment of the present invention provides a system for operating a gate comprising: a computing device producing an indicator of an amount of time to release a starting gate; a sensor that senses the indicator and transfers the sensed indication to a switch or valve; or other suitable actuator mechanism operatively connected to the sensor, wherein the actuator mechanism releases the starting gate when the amount of time has expired.

The present invention includes an electronic interface computing device to control a racing starting gate. The inventive present invention may interface with common programmable electronic devices such as a smart phone, tablet or PC that has a visual display and/or audible output signal. The present invention interfaces between the common electronic devices and the racing starting gate in a manner that enables these common programmable electronic devices to operate the functions of the starting gate. This enables racers to operate a starting gate with a desired starting sequence, which may be programmed to comply with the official starting sequence used by the race sanctioning organizations.

It is highly desirable to replicate the official starting sequences for the purpose of practice by using only a cell phone or other conveniently available computer devices as a controller. The present invention eliminates the cost of a special purpose built controller and Instead incorporates the functions of common electronic devices that most racers already own.

The present inventive device enables common consumer electronic equipment to interface with a starting gate to perform the gate control function. Expensive electronic gate controllers are thereby replaced by any one of a variety common electronics that may be more affordable, practical or easily available. In certain embodiments, the present invention operates by detecting visible images on the panel display of the common programmable electronic device, which advantageously leaves the headphone jack available for connection to other equipment such as an amplified speaker, which may provide necessary or desirable audible aspects of the starting sequence.

The device of the present invention uses optical sensors to respond to images on the display screen of the users' phone or other computerized devices. Alternatively, the audio signal outputs on phones, tablets or computers can also be used to control a starting gate. The fact that the inventive device is optically driven allows the speaker/headphone connection to be used separately for the audible signals that are necessary elements of the starting sequence. The present invention allows a variety of portable electronic devices to perform the control function using the same cadence or sequence of signals the riders experience at the racetrack.

The device of the present invention is much more affordable because it flexibly allows the use of a variety of computerized devices that a racer is likely to already own, and which are programmable, and can emulate the official starting cadence used at the sanctioned race tracks.

Referring now to the FIGURE, the system is controlled by a smart phone (5) or other programmable electronic device. The sensor (4) may be affixed into a position that can detect the light from an image, such as a starting tree image on the screen. Alternatively, a suitable type of sensor can be connected to the programmable device (5) to detect the audible or electronic signal from the program that is intended to correspond to the release of a starting gate. If a signal from the programmable device (5) is detected by the detector (4), then the signal from the programmable device (5) is amplified or otherwise processed by the interface (3) to provide an output signal that is capable of switching a control element (8) such as a relay switch or a solenoid valve to operate a magnetic fluid or gas driven actuator mechanism. The actuator mechanism (2) may be powered by a power supply (7), which can be electrical or In the form of pressurized gas or fluid. The user can hear the audible portion of the starting sequence, either by the built in speaker on the programmable electronic device (5) or by using optional speaker (6), many varieties of which are commonly available for use with the applicable programmable electronic devices (5). The functions of items 3, 4, 7 and 8 or even 6 may be incorporated into a single unit or device, which interfaces between the gate actuator mechanism (2) and the common programmable device (5), to perform the Intended control functions for the starting gate (1), which may be of the type that falls toward or away from the user.

The starting gate (1) may remain in the upright, closed or latched position until released by the switch or valve (8). If sensor (4) detects the signal from the programmable device (5), then the signal may be interpreted, translated and/or amplified into a form that will cause the switch or valve (8) to operatively allow the power supply (7) to act on the release mechanism (2). If the power supply (7) operatively engages the release mechanism (2), then the gate (1) may be released, raised or opened.

To use the program, the user downloads or programs a starting sequence emulation program onto his programmable device. For example, a user might download a program such as "Random Gate" onto his smart phone. The sensor is connected to the programmable electronic device, possibly using a suction cup on the display panel. The device of the present invention is connected to the gate actuator mechanism and optionally a speaker. The gate is raised or closed, the user assumes the starting position and then initiates the starting sequence on the programmable device. For example, the user may initiate a bicycle racing starting cadence on the touch screen of the programmable device. When the detector senses the light from a light tree image on the screen, or otherwise senses the signal from the programmable device, the signal is interpreted by the inventive device to operate the starting gate.

Programs are readily available that reproduces the audible aspects or the visual aspects of a starting routine for various types of racing, such as bicycle, motorcycle, etc. These programs are intended to run on common electronic devices such as smart phones, tablets or laptop computers but they have no inherent means of operating an actual starting gate. They merely emulate the visual and/or audible aspects of the starting sequence, cadence or routine. The present invention includes an interface that couples these common electronic devices to the functioning mechanisms that can operate a starting gate, thereby enhancing the value of the programmable electronic devices and software, and allowing users to operate a starting gate without expensive dedicated electronic gate controllers.

The present invention may be made by connecting a sensor, for example such as a photo resistor, phototransistor or microphone, to an electronic circuit that can amplify the signal end/or directly operate a switch or valve. For example, the present invention may use a series of transistors to amplify the signal, as detected by a photo resistor from the screen of a smart phone, which thereby energizes a relay switch. The relay switch breaks the circuit that energizes an electromagnet, which otherwise holds the gate in an upright position. The gate may be fashioned from any number of commonly available components.

Some or all of the elements of the present invention could be combined into a single unit, which could be mounted on the starting gate itself or remotely. The present invention may be connected to the programmable electronic device by direct (wire) connection or wireless connection. The present invention may use a smart phone or other non-specialized programmable device to operate a starting gate. It is an intended benefit of the Invention to adapt a non-specialized device for the purpose of operating a starting gate, thereby adding a valuable aspect of functionality to the programmable device. A suitable program may be used for the programmable device to perform the gate control functions but the programmable device need not be specifically intended to operate a starting gate. The program may emulate the starting sequence visually and/or audibly. The unique function of the present invention is that it interprets these signals, to enable them to perform the function of operating the starting gate. The invention could foreseeably also include connections to a remote starting light display. It could also be connected to the various components wirelessly. The present invention may also incorporate time delays, either fixed or random, to suit the needs of the user.

It should be understood, of course, that the foregoing relates to exemplary embodiments of the invention and that modifications may be made without departing from the spirit and scope of the invention as set forth in the following claims.

I claim:

1. A system for operating a race starting gate comprising:

a. a starting gate comprising an actuator mechanism for operating the starting gate;

b. an indicator device that produces one or more signals;

c. a sensor in communication with the indicator device that detects and transmits the one or more signals; and d. a control element in communication with the actuator mechanism, wherein the control element receives the one or more signals from the sensor, and wherein the control element operates the actuator mechanism based on the signal transmitted from the sensor, wherein the sensor is integrated into a suction cup, wherein the suction cup releasably connects to the indicator device, and wherein the sensor is selected from the group consisting of a photo resistor, a phototransistor, and a microphone.

2. The system of claim 1, wherein the indicator device comprises a speaker, wherein the sensor detects and transmits an audible signal emitted from the speaker to the control element, releasing the actuator mechanism and moving the starting gate from a closed position to an open position.

3. The system of claim 2, wherein the speaker is an external speaker electrically connected to the indicator device through an audio output jack.

4. The system of claim 2, wherein the audible signal is a starting sequence of a race.

5. The system of claim 1, wherein the indicator device comprises an audio output jack, wherein the sensor is electrically connected to the audio output jack.

6. The system of claim 1, wherein the signal is a race starting sequence emulation.

7. The system of claim 6, wherein the indicator device is selected from the group consisting of a phone, a computer, and a tablet.

8. A system for operating a race starting gate comprising:

a. a starting gate comprising an actuator mechanism for operating the starting gate;

b. an indicator device that produces one or more signals;

c. a sensor in communication with the indicator device that detects and transmits the one or more signals; and d. a control element in communication with the actuator mechanism, wherein the control element receives the one or more signals from the sensor, and wherein the control element operates the actuator mechanism based on the signal transmitted from the sensor, a wherein the indicator device comprises an electronic display, and wherein a suction cup releasably couples the sensor to the display, wherein the sensor detects and transmits a light signal emitted from the display to the control element, releasing the actuator mechanism and moving the starting gate from a closed position to an open position.

9. The system of claim 8, wherein the indicator device further comprises an audio output jack, wherein an external speaker is electrically connected to the indicator device through the audio output jack, wherein the external speaker provides an audible indicator of a race starting sequence to a racer.

10. The system of claim 8, wherein the light signal is a starting sequence of a race, wherein the starting sequence is a light tree.

11. The system of claim 8, wherein the indicator device comprises a speaker, wherein the sensor detects and transmits an audible signal emitted from the speaker to the control element, releasing the actuator mechanism and moving the starting gate from a closed position to an open position.

12. The system of claim 11, wherein the speaker is an external speaker electrically connected to the indicator device through an audio output jack.

13. The system of claim 11, wherein the audible signal is a starting sequence of a race.

14. The system of claim 8, wherein the light signal is a starting sequence of a race, wherein the starting sequence is a light tree.

15. The system of claim 8, wherein the indicator device comprises an audio output jack, wherein the sensor is electrically connected to the audio output jack.

16. The system of claim 8, wherein the signal is a race starting sequence emulation.

17. The system of claim 16, wherein the indicator device is selected from the group consisting of a phone, a computer, and a tablet.

* * * * *